United States Patent [19]

Keeler et al.

[11] 4,295,012

[45] Oct. 13, 1981

[54] SECRETARIAL SHIFT MECHANISM FOR AN ELECTRIC KEYBOARD

[75] Inventors: Robert J. Keeler, Elmhurst; Stanley E. Filipiak, Chicago, both of Ill.

[73] Assignee: Illinois Tool Works Inc., Chicago, Ill.

[21] Appl. No.: 118,038

[22] Filed: Feb. 4, 1980

[51] Int. Cl.[3] ..... H01H 9/20

[52] U.S. Cl. ..... 200/5 B; 200/50 C; 400/276

[58] Field of Search ..... 400/479, 479.2, 276; 200/153 J, 330, 5 B, 50 C

[56] References Cited

U.S. PATENT DOCUMENTS 3,715,023 2/1973 Jackson et al. ..... 400/479.2

3,863,748 2/1975 Trezise ..... 400/276

*Primary Examiner*—B. Dobeck

*Assistant Examiner*—Morris Ginsburg

*Attorney, Agent, or Firm*—Glenn W. Bowen; Thomas W. Buckman

[57] ABSTRACT

A secretarial shift mechanism which includes two shift keyswitches and one shift lock keyswitch is disclosed. The two shift keyswitches have T-shaped actuating bars secured to their plungers. The shift lock and release keyswitch has a generally C-shaped wire spring retainer placed around its housing which is utilized to secure a hook on a latching finger on a ledge that is formed on the plunger of the shift lock keyswitch. The latching finger is secured to an elongated torsion bar which has a pair of arms at the ends of the bar that are bent toward the two shift keyswitches. The torsion bar is held at its ends against the frame that holds the keyswitches of the keyboard by clamping caps that project from the shift keyswitches and have grooves in them that receive the torsion bar therein. When the shift lock keyswitch is depressed, a hook on the latching finger that is secured at the torsion bar engages a ledge on the plunger of the shift lock keyswitch and holds it down. Depression of either of the shift keyswitches causes the T-bar on the keyswitch to engage the bent arms on the torsion bar, which in turn results in twisting of the torsion bar sufficiently to deflect the latching finger so the lock is off of the ledge which releases the shift lock keyswitch from its actuated condition.

8 Claims, 8 Drawing Figures

Fig. 4
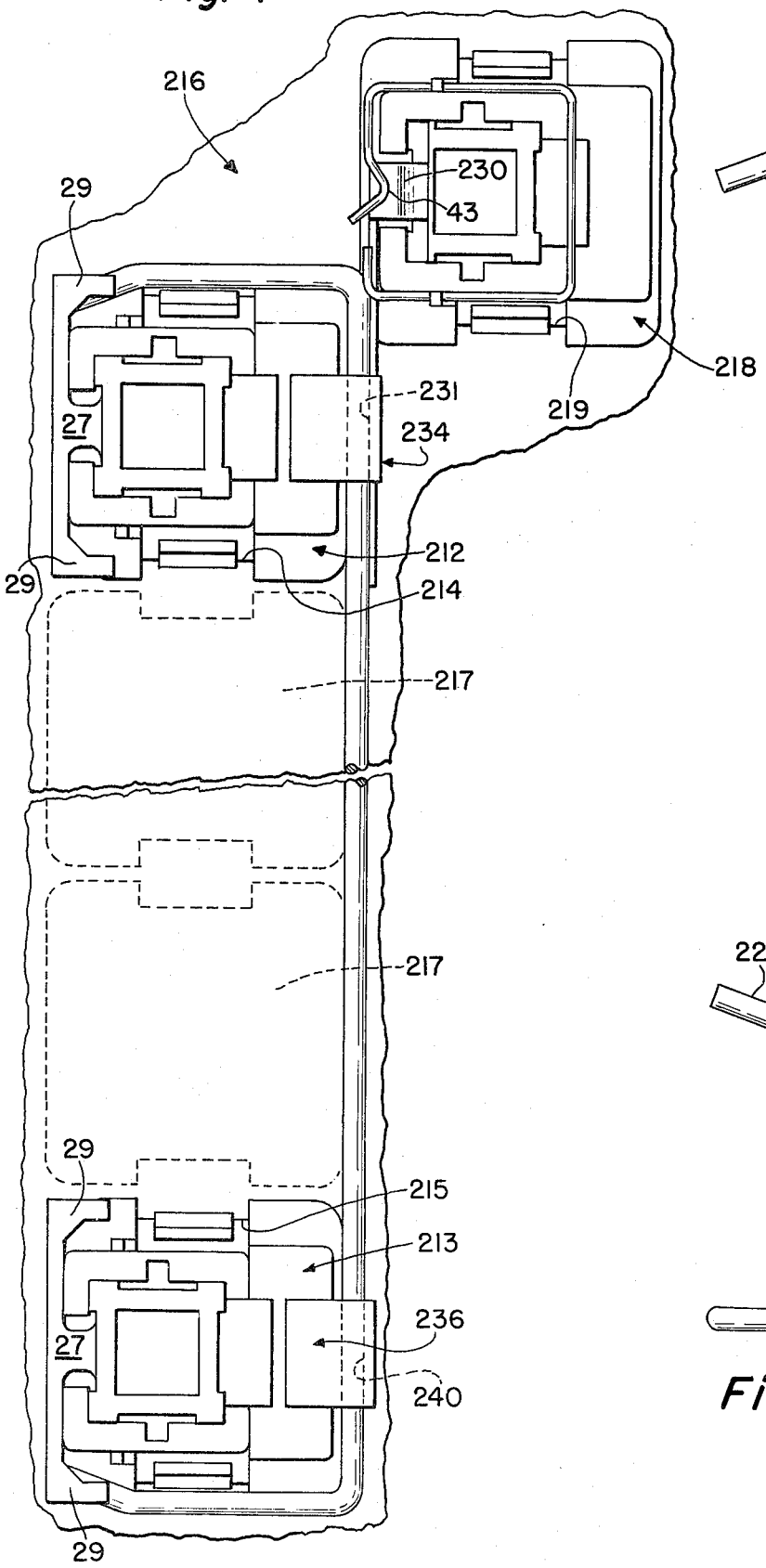
Fig. 5
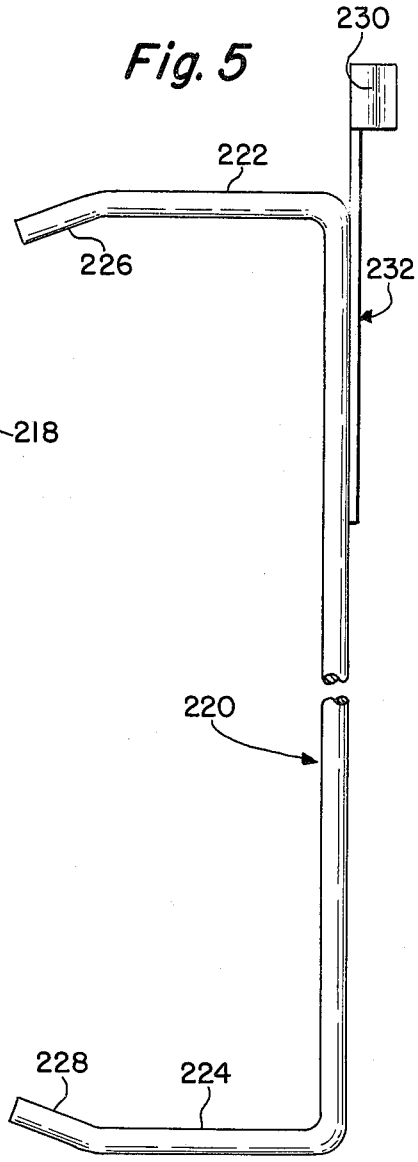
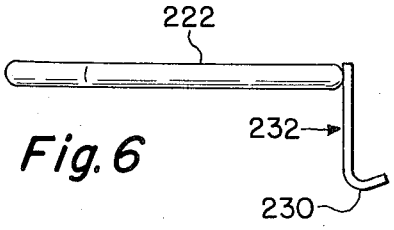
Fig. 6

SECRETARIAL SHIFT MECHANISM FOR AN ELECTRIC KEYBOARD

BACKGROUND OF THE INVENTION

Shift and shift lock and release mechanisms, which are known as secretarial shift mechanisms, are commonly employed on keyboards. The mechanisms are often unduly complex and result in excessive manufacturing and assembly costs. One attempt of reducing the complexity of such keyboards is described in U.S. Pat. No. 4,071,719, which issued Jan. 31, 1978, in the name of Robert Christen Madland and which is assigned to the assignee of the present invention. The keyboard of the Madland patent was a substantial improvement in reducing the complexity of such mechanisms since it required only a single elongated connecting rod between the keyswitches. However, the Madland keyboard did require that the keyboard employ the shift and shift lock keyswitches which required the addition of slideable cam followers on the top of the housing of the keyswitch and which were actuated by a cam that was formed on the plunger of the keyswitch. Thus, while the keyboard of the prior Madland patent substantially reduced the assembly cost of a secretarial shift mechanism, since the cost was essentially the same as the cost of inserting three standard keyswitches into the keyboard, this design still required the manufacture of special keyswitches that were more complex than desired.

The present invention, by contrast, may utilize keyswitches that are basically the same as the other keyswitches of the keyboard, for both the shift and shift lock release functions. In the case of the shift keyswitch it is only required to add a generally T-shaped actuating bar to the plunger of the basic keyswitch of the keyboard. For the shift lock and release keyswitch it is necessary only to add a generally C-shaped retaining spring around the housing of the basic keyswitch of the keyboard. The shift and shift lock and release keyswitches correspond generally to those of U.S. Pat. No. 4,227,163 issued Oct. 7, 1980 in the name of Raymond Barnoski, entitled "Electrical Keyswitch" and assigned to the assignee of the present invention. A pair of retaining wedges support are required on the outer housing of the shift lock and release keyswitch for the wire spring retainer. In addition, slots are required in the housing of the keyswitches of the present invention that are not needed by the switches of U.S. Pat. No. 4,227,163 to allow for the latching finger on the shift lock and release keyswitch (hereafter called the shift lock keyswitch for short) and for movement of the T-shaped actuating bar on the shift keyswitches. However, these features may merely be provided on all keyswitches of the keyboard if desired and the only additional features that would then be required for the shift and shift lock keyswitches are the T-shaped bars and the C-shaped wire spring retainer.

DESCRIPTION OF THE DRAWINGS

The present invention is described by reference to the drawings in which:

FIG. 2 is a bottom view of the switches of FIGS. 1 and 3;

FIG. 4 is a partial top view of a keyboard which shows the two shift keyswitches, a shift lock keyswitch and the torsion bar which is utilized to actuate the secretarial shift mechanism;

FIG. 5 is a top view of the torsion release mechanism and the latching finger which is welded to it;

FIG. 6 is a side view of the torsion bar and latching finger of FIG. 5;

TECHNICAL DESCRIPTION OF THE INVENTION

Keyswitches for electrical keyboards may be either of the mechanical contact type or of the analog contactless type, wherein a magnet controls the actuation state of the switch by determining the saturation state of a closed-loop magnetic core that is threaded by drive and sense lines.

The mechanical type of keyswitch has the advantage of being relatively low in cost, and for many applications this factor makes it desirable to employ such a mechanical keyswitch. However, mechanical keyswitches have a number of disadvantages that make them undesirable for use in applications where high reliability is required and the added cost of an analog switch is, therefore, considered to be warranted. These disadvantages include contact bounce, the possibility of arcing, lower life times due to pitting and corrosion and possible deformation of the contact members.

Analog switches, such as the magnetic saturable core, offer greatly reliability, but at a higher cost. In addition, such switches generally require some sort of circuit modification to supply "hysteresis," or a reduced sensitivity of the sensing circuit after a keyswitch has been actuated to prevent electrical noise from producing false output signals. In applications where high reliability is necessary, however, analog switches provide the utmost in dependability and endurance.

It would be desirble for keyboard manufacturers to have the capability of making keyboards with either type of keyswitch, or of even including both types of keyswitches in a single keyboard, in accordance with their customer's wishes. However, previously this has required the manufacture and stocking of two separate types of keyswitches, with added cost and complications.

The electrical keyswitch, described in U.S. Pat. No. 4,227,163 issued Oct. 7, 1980, in the name of Raymond Barnoski and is assigned to the assignee of the present invention, provides a simple electrical keyswitch that is capable of being operated either as an analog magnetic type of contactless keyswitch or as a mechanical type of keyswitch with only minor modifications being necessary to convert from one to the other, due to the improved design provisions that are provided for the keyswitches. In addition, for special applications, both types of keyswitches could be simultaneously incorporated into one keyswitch component if desired; and the present invention is described by reference to FIGS. 1 and 3 wherein the shift keyswitches are described as being analog magnetic core type of switches and the shift lock keyswitch is described as being a mechanical keyswitch. It is understood, of course, that either switch may be either an analog or a mechanical contact type, if desired, as the type of switch employed does not alter the present invention.

Figures 1, 3:
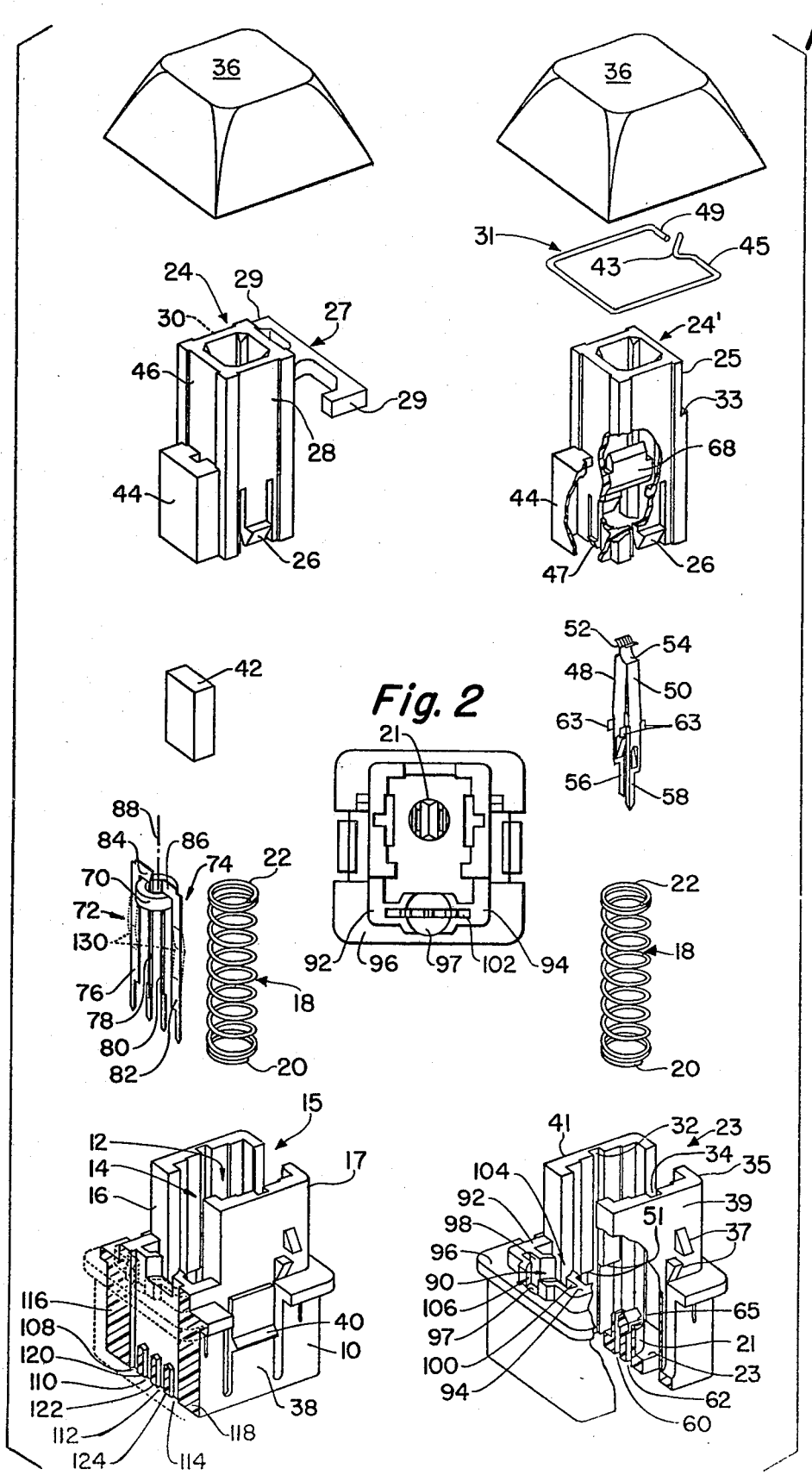
FIG. 1 is an exploded perspective view of a keyswitch which may be utilized as a shift keyswitch in the present invention that utilizes magnetic core switching.
FIG. 3 is a perspective exploded view of a keyswitch which may be utilized in the present invention as the shift lock keyswitch that utilizes mechanical contacts.

One suitable keyswitch for use with the present invention is shown in its analog version in FIG. 1, and in its mechanical version in FIG. 3. FIG. 2 shows a top view of the base of the keyswitch, which is formed of an electrically insulating plastic material. The base 10 of the keyswitch is formed with an integral, hollow, generally rectangular-shaped guide chamber 12 that extends upwardly from the base and has a slot 14 formed in the front side 16 of the chamber. An additional slot 15 that does not appear in the keyswitch of U.S. Pat. No. 4,227,163 is provided in the rear side 17 of the base 10. A coiled return spring 18 is inserted into the guide chamber 12 with the lower end 20 of the spring receiving the projection 21 that extends upwardly from the bottom surface 23 of the base. The upper end 22 of the spring is inserted into the hollow, generally rectangular-shaped plunger 24 in order to bias it upwardly so as to return it to its initial position after the plunger has been depressed and pressure on the plunger has been released.

The plunger 24 has a pair of resilient looking feet 26 on the opposite sides 28, 30 of the plunger to hold it in the guide chamber 12. When the feet 26 are pressed inwardly, the plunger is inserted into the guide chamber and then the inward pressure on the feet is released so that they will spring outwardly and engage the ledges 51 in the interior of the guide chamber so as to prevent the plunger from being inadvertently removed from the guide chamber. Two elongated generally rectangular shaped grooves 32, 34, on opposite interior surfaces of the guide chamber 12, are provided so that a tool may be inserted into the guide chamber that can depress the feet 26 inwardly when the plunger is to be removed.

A key cap 36 is provided which will indicate the identifying indicia for a particular key and which snaps on the top of the plunger. The base 10 of the keyswitch has a pair of resilient arms 38 on opposite sides of the base. The arms have a projection 40 that allows the keyswitch to be locked into an aperture in a printed circuit board, or other suitable support member, for the keyswitch.

The plunger 24 of the keyswitch is adaptable to provide an analog type of contactless switch when a small magnet 42 is inserted into the container 44 that is carried on the side 46 of the plunger, and held in place by a resilient locking foot 47. The side 46 of the plunger faces the side 16 of the guide chamber so that as the plunger moves up and down the magnet 42 and container 44 will correspondingly move up and down in the slot 14. By carrying the magnet on the side 46 of the plunger and by making the plunger hollow, the keyswitch is also adaptable for alternate, or simultaneous, use as a mechanical keyswitch.

The switch of FIG. 1, which is described as the shift keyswitches, herein, also has an actuator bar 27 secured to the plunger 24, or integrally formed on the plunger. The bar requires only one of the arms 29; but to make it useful for both keyswitches, it preferably has a generally T-shaped configuration as shown. The previously mentioned slot 15, therefore, is provided to allow for motion of a plunger with an actuator bar attached to it.

The mechanical contacts 48, 50 of the switch of FIG. 3, which is described as the shift lock keyswitch, herein, are of the normally-closed type, and they are formed of two elongated conductive members that have C-shaped contact portions 52, 54 at their upper ends. Each of the contact portions 52, 54 are preferably formed of a multitude of individual contact fingers in order to achieve a high reliability contact. The lower ends 56, 58 of the contacts 48, 50 are reduced in size and project through the slots 60, 62 in the upstanding projection 21. The contacts also have outwardly projecting wings 63 that fit into corresponding horizontal grooves 65 in the projection 21 to retain the contacts 48, 50 in their proper positions in the switch.

The plunger 24' is made hollow so that the contact portions 52, 54 of the mechanical contacts extend up into the lower interior portion of the plunger. A separator bar 68, for separating the normally-closed contacts 48, 50 when the plunger is depressed, is integrally formed across the hollow of the plunger, preferably at a position vertically removed from the bottom of the plunger so as to provide for a low-profile keyswitch, which is desired by many keyboard users. The shift lock switch of FIG. 3 also has a slot 23 cut in the rear side 35 of the switch, which slot did not appear in the keyswitch of U.S. Pat. No. 4,227,163. This switch is further modified by cutting back part of the rear wall 25 of the plunger to form the locking ledge 33. In addition, a retaining spring 31 of a generally C-shaped configuration is slipped over the base of the keyswitch and is supported by a pair of support wedges 37 on each of the sides 39 and 41. The spring 31 has an inward bend 43 on the arm 45, while the arm 49 is straight. The function of the spring 31 and the bend 43 is to retain a locking finger in place in the slot 23 adjacent the rear side 25 of the plunger, as will subsequently be described in more detail.

The analog type of keyswitch illustrated in FIG. 1 utilizes a closed loop, preferably a toroidal-shaped magnetically saturable magnetic core 70. In this type of switch the magnet 42 is located adjacent the core 70 when the plunger is not depressed. A U-shaped, flat drive line 72 and a U-shaped, flat sense line 74 is threaded through the core so that the sense line may pick up an electromagnetic signal when a pulse of current is supplied through the drive line, providing the core 70 is not magnetically saturated. When the plunger is in its undepressed position, the core 70 will be magnetically saturated and thus pulses of current on the drive line will not produce output signals on the sense line. However, when the plunger is depressed the magnet will move away from the core thereby allowing the core to come out of magnetic saturation so that the drive line signals will now be transformed to the sense line.

Although U-shaped drive and sense lines have previously been used in this type of keyswitch, they were generally formed of round wires and thus previous drive and sense line configurations did not lend themselves readily to automatic manufacture where a large number of such lines could be formed merely by stamping out a single sheet of conductive metal. Such stamped conductors provide for low-cost components that are suitable for automated handling. The drive and sense lines that are formed in this manner each have a pair of parallel straight legs, such as the legs 76, 78, 80 and 82, and sections between the legs, such as the sections 84, 86, that are located above the core 70 when the core is positioned so that its axis 88 is oriented in a vertical direction, as shown in FIG. 1.

The keyswitch of FIG. 1 is designed to facilitate insertion of the flat drive and sense lines and the core into their final position in the assembled keyswitch. The core 70 is retained in a retaining well 90 which is formed of a pair of upstanding walls 92, 94 that extend vertically from the horizontal surface 96 on the base 10. When the core 70 is held in the retaining well 90, the bottom, or lowermost portion of the core rests on the horizontal surface 97 and the top, or uppermost portion, of the core is uncovered and the axis 88 of the core is then vertically oriented. The walls 92, 94 have the grooves 98, 100 respectively formed in them so that the outer legs 76 and 82 of the drive and sense lines, respectively pass through these grooves when the core and the sense lines are inserted into the switch. An elongated slot 102, as seen in FIG. 2 passes through the surface 97 and extends below the grooves 98, 100 so that all of the legs 76–82 of the drive and sense lines may pass through the slot 102. The walls 92, 94 are spaced to provide an opening 104 adjacent the side 46 of the plunger so as to reduce the clearance between the core and the magnet. Another opening 106 is provided on the opposite side of the walls to allow for visual inspection of the switch to see if it is carrying a core.

In assembling, the magnetic core 70 may first be inserted from the bottom of the drive and sense lines, to the position shown in FIG. 1. The drive and sense lines and the core may then be pressed downwardly as a unit so that the legs 76, 78, 80 and 82 pass through the corresponding receiving passageways 108, 110, 112 and 114, respectively, that are formed in the interior of the base by the outer walls 116, 118 of the base and the three elongated, generally parallel, electrically insulating dividers 120, 122, 124.

The described retaining and assembly provisions for core 70 and the drive and sense lines 72, 74 allow for easy insertion of these elements into the keyswitch. The passageways provided for the leads are dimensions so that they are tight fitting with respect to the drive and sense lines. The leads, however, may be additionally bent as represented by the dotted lines 130 on the legs 76, 82 if a tighter fit is desired. In such a case, the switches may even be turned upside down without the core and the drive lines dropping out; but they can still be easily removed by pressure on the bottom of the leads. The core and drive line assembly thus may be very easily removed without disassembly of any other part of the keyswitch if replacement of a defective core becomes necessary. This easy removal of defective sensing elements gives the described keyswitch of FIG. 1 a decided advantage over prior analog types of contactless switches.

The mechanism of the present invention may employ one or two shift keyswitches 212, 213, which may be inserted into corresponding apertures 214, 215 at opposite ends of the keyboard 216, and a shift lock keyswitch in the aperture 219. The option of providing a shift release from either of the shift keyswitches is commonly referred to as a "secretarial-shift mechanism" and requires two shift keyswitches. The mechanism could also be utilized, however, with only the shift lock keyswitch 218 and the adjacent shift keyswitch 212. Besides the keyswitches 212 and 213 there are a number of other apertures 217 which are aligned in a row and which may receive data or function keyswitches therein.

A torsion bar 220, which is shown in FIG. 5, extends across the entire keyboard in the preferred two shift keyswitch embodiment shown in FIG. 4. The torsion bar 220 has a general C-shaped configuration with a pair of inwardly bent arms 222, 224 that extend toward the keyswitches 212 and 213. The extreme end of the arms 222 and 224 have a more sharply inwardly bent section 226, 228, and it is this portion of the arm that engages the arms 29 of the actuator bar 27 shown in the keyswitch of FIG. 1. Though only one arm 29 is required for the keyswitch 212 and the opposite arm 29 is required for the keyswitch 213, it is preferable that both of the arms be utilized to standardize the construction of the actuator bar 27, and thus the bar 27 has a general T-shaped configuration.

A locking finger 232 is welded, or secured by other means, to the torsion bar 220, as shown in FIG. 5. The finger 232 has a hooked end 230 which engages the ledge 33 of the switch 218. The bend 43 of the wire retainer spring 31 is forced against the locking finger 232 to hold it into place due to the spring force supplied by the arm 45. The wire retainer spring 31 is an optional item which may be employed to reduce the resiliency requirements of the locking finger 232, since it is possible to provide a locking finger with suitable resiliency so that this wire retainer 31 might be eliminated. However, such a locking finger is generally more difficult and costly to make.

The torsion bar 220 is free to rotate, or twist, and is held down only by the plastic clamping caps 234, 236 which are adjacent to the shift keyswitches 212, 213, respectively. The clamping caps 234, 236 may be separate members which are secured to the frame of the keyboard, but preferably they are formed as a cap which may be fastened to the keyswitch as a cover over the core retaining well 90. The clamping caps are provided with semi-cylindrical grooves 231, 240 which receive the ends of the torsion bar 220 therein so as to hold the torsion bar 220 down at its end while still allowing it to rotate or twist.

Figure 8:
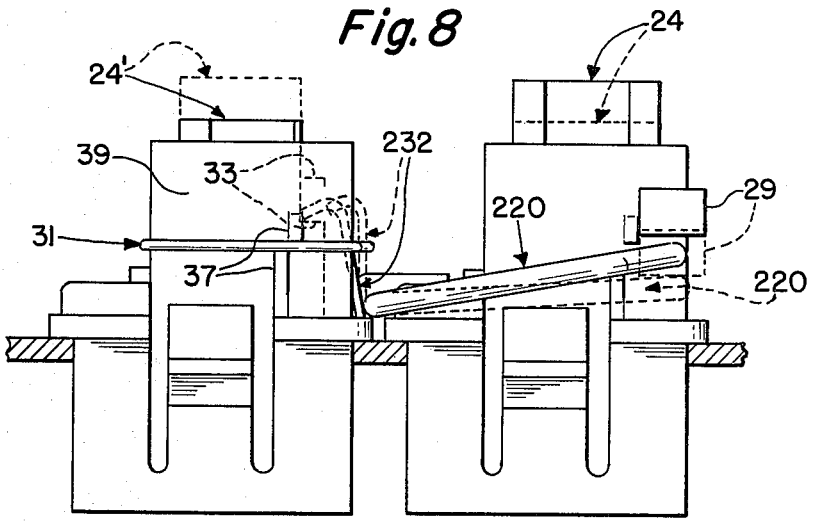
FIG. 8 is a side view of the shift lock keyswitch and the adjacent shift keyswitch which illustrates the operation of the present invention.

In operation, depression of the plunger 24' of the shift lock keyswitch 218 causes the hook 230 of the locking finger 232 to engage the ledge 33 thereby holding the plunger 24' in the depressed positions as shown in FIG. 8. The depressed state of the keyswitch 218 causes a series of repeating shift signals which continue as long as the plunger 24' remains depressed.

When it is desired to release the shift lock keyswitch from its depressed condition, either of the shift keyswitches 212 or 213 may be depressed so that one arm 29 of the actuating bar 27 engages one of the ends 226, 228 of the torsion bar 220 causing the bar 220 to twist and the hook 230 to be pulled away from the ledge 33, as shown in FIG. 8.

Figure 7:
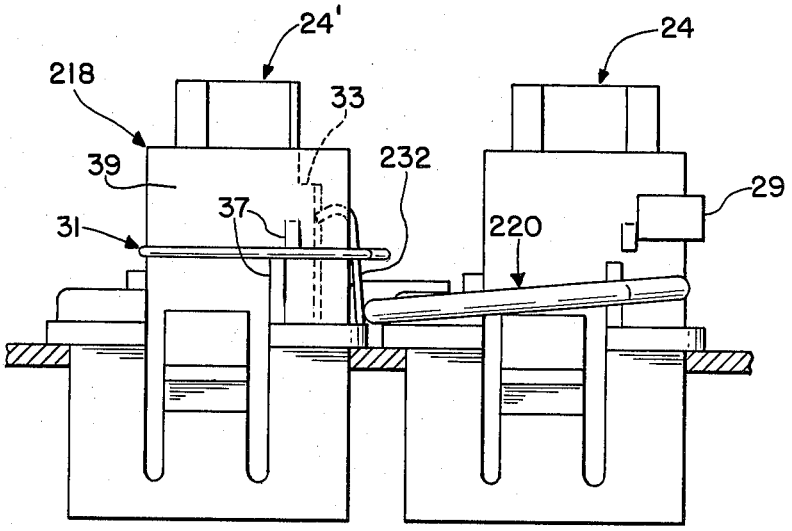
FIG. 7 is a side view of a shift lock keyswitch and the adjacent shift keyswitch which illustrates the present invention when the shift and shift lock keyswitch are both in the released state.

Thus, when the shift keyswitch is depressed the actuator bar 27 engages the ends 226 or 228 of the torsion bar 220 causing it to rotate slightly. This in turn causes the locking hook 230 to pull back so that the hooked end 232 is released from engagement with the ledge 33, as shown by the dotted lines in FIG. 8. Once the plunger 24 of a shift keyswitch has been fully depressed, the plunger of the shift lock keyswitch 218 will be driven to its undepressed, or released, position due to the force of the spring 18, as shown by the dotted lines in FIG. 7, thereby terminating the repeating shift signal. Subsequent depression of either keyswitch 212 or 213 will then result in a single shift key output pulse. Therefore, the mechanism of the present invention provides a secretarial shift mechanism for a keyboard in an extremely uncomplicated, yet reliable, manner which requires only very minimal modification of the keyswitches of the keyboard.

What is claimed is:

1. A keyboard mechanism comprising a shift keyswitch and a shift lock keyswitch positioned adjacent said shift keyswitch wherein each of said keyswitches comprises a switching means, a housing with a base for said switching means, an actuating member in the form of a plunger within said housing mounted for movement relative to said housing base from an initial undepressed position to a depressed position for actuating said switching means when said actuating member is in said depressed position, resilient means for returning said actuating member to its undepressed position and wherein said mechanism further comprises a ledge formed on said actuating member of said shift lock keyswitch, locking means which is resiliently biased toward said ledge and which engages said ledge so as to hold said actuating member of said shift lock keyswitch in its depressed position when said actuating member of said shift keyswitch is in its undepressed position, but which does not engage said ledge when said actuating member of said shift lock keyswitch is in its undepressed position and said actuating member of said shift keyswitch is depressed, rotatable release means connected to said locking means and an actuator bar operable exteriorly of said housing and including an arm connected to said actuating member of said shift keyswitch which is constructed to engage said rotatable release means when said actuating member of said shift keyswitch is depressed and said actuating member of said shift lock keyswitch is held in its depressed position in a manner which causes said rotatable release means to rotate sufficiently far to allow said locking means to be withdrawn clear of said ledge which in turn allows said actuating member of said shift lock keyswitch to be returned to its initial undepressed position by said resilient means of said shift lock keyswitch.

2. A keyboard mechanism as claimed in claim 1 wherein resilient biasing of said locking means toward said ledge is applied by a spring wire retainer that encircles said housing base of said shift lock keyswitch with said spring wire retainer being constructed to have two arms, one of which has an inward bend that engages said locking means and resiliently forces it toward said ledge.

3. A keyboard mechanism as claimed in claim 1 wherein said locking means comprises a locking finger that has a hooked end which engages said ledge.

4. A keyboard mechanism as claimed in claim 3 wherein resilient biasing of said locking means toward said ledge is applied by a spring wire retainer that encircles said housing base of said shift lock keyswitch with said spring wire retainer being constructed to have two arms, one of which has an inward bend that engages said locking means and resiliently forces it toward said ledge.

5. A keyboard mechanism comprising a pair of spaced-apart shift keyswitches and a shift lock keyswitch, one of said shift keyswitches being positioned adjacent said shift lock keyswitch, wherein each of said shift and shift lock keyswitches comprises a switching means, a housing base for said switching means, an actuating member mounted for movement relative to said housing base from an initial undepressed position to a depressed position for actuating said switching means when said actuating member is in said depressed position, resilient means for returning said actuating member to its undepressed position and wherein said mechanism further comprises a ledge formed on said actuating member of said shift lock keyswitch, locking means which is resiliently biased toward said ledge and which engages said ledge so as to hold said actuating member of said shift lock keyswitch in its depressed position when both of said actuating members of said shift keyswitches are in their undepressed positions, but which does not engage said ledge when said actuating member of said shift lock keyswitch is in its undepressed position and said actuating member of either of said shift keyswitches is depressed, an elongated torsion bar release means connected to said locking means, a pair of hold-down means each adjacent one of said shift keyswitches which holds down said torsion bar release means while allowing the rotation thereof, and first and second actuator bars each connected to one of said actuating members of said shift keyswitches, said torsion bar release means being constructed to have a bent arm at each end thereof which is adjacent said actuator bar of one of said shift keyswitches, said actuator bars being constructed to engage the adjacent one of said arms when said actuating member of said adjacent shift keyswitches is depressed and said actuating member of said shift lock keyswitch is held in its depressed position in a manner which causes said torsion bar to rotate sufficiently far to allow said locking means to be withdrawn clear of said ledge, which in turn causes said actuating member of said shift lock keyswitch to be returned to its initial undepressed position by said resilient means of said shift lock keyswitch.

6. A keyboard mechanism as claimed in claim 5 wherein resilient biasing of said locking means toward said ledge is applied by a spring wire retainer that encircles said housing base of said shift lock keyswitch with said spring wire retainer being constructed to have two arms, one of which has an inward bend that engages said locking means and resiliently forces it toward said ledge.

7. A keyboard mechanism as claimed in claim 5 wherein said locking means comprises a locking finger that has a hooked end which engages said ledge.

8. A keyboard mechanism as claimed in claim 7 wherein resilient biasing of said locking means toward said ledge is applied by a spring wire retainer that encircles said housing base of said shift lock keyswitch with said spring wire retainer being constructed to have two arms, one of which has an inward bend that engages said locking means and resiliently forces it toward said ledge.

* * * * *